US006739740B1

(12) United States Patent
Feldman

(10) Patent No.: US 6,739,740 B1
(45) Date of Patent: May 25, 2004

(54) CHANNEL SLOT COVER FOR TRACK LIGHTING

(76) Inventor: Lee D. Feldman, 26691 W. Haven Dr., Laguna Hills, CA (US) 92653

( * ) Notice: Subject to any disclaimer, the term of this patent is extended or adjusted under 35 U.S.C. 154(b) by 0 days.

(21) Appl. No.: 10/351,325

(22) Filed: Jan. 27, 2003

(51) Int. Cl.[7] ..... F21V 21/02

(52) U.S. Cl. ..... 362/404; 362/252; 362/147; 362/374

(58) Field of Search ..... 362/404, 252, 362/147, 374, 457, 458

(56) References Cited

U.S. PATENT DOCUMENTS 4,245,874 A * 1/1981 Bishop ..... 439/94
5,653,412 A * 8/1997 Martorano et al. .... 248/222.11
5,664,876 A * 9/1997 Vafai et al. ..... 362/249
6,093,037 A * 7/2000 Lin ..... 439/115
6,170,967 B1 * 1/2001 Usher et al. ..... 362/394

* cited by examiner

*Primary Examiner*—Thomas M. Sember
(74) *Attorney, Agent, or Firm*—Edward E. Roberts

(57) ABSTRACT

An electrical lighting apparatus includes a track carrying electrical conductor strips and including a slot for receiving light fixtures. A flexible slot cover is provided to cover the open slot disposed between light fixtures. The cover includes a compressible resilient portion for easy manual insertion into and removal from said slot without the use of hand tools, and a relatively hard surface portion precluding slot insertion whereby with insertion of the compressible portion into the slot, the surface portion abutting overlays the edges of said slot. The slot cover is of such material that it can be sold in strips and easily cut to a desired length. The compressible portion may be fire retardant and provide electrical insulation, and the surface portion can be manufactured in any desired color, thus providing an esthetically pleasing appearance to the installed track lighting system.

16 Claims, 2 Drawing Sheets

CHANNEL SLOT COVER FOR TRACK LIGHTING

BACKGROUND OF THE INVENTION

The background of the invention will be discussed in two parts.

1. Field of the Invention

The invention relates to track-lighting systems and in particular to a slot cover for such systems that has easy handling during assembly and use, lower cost during manufacture, increased safety, and provides improved appearance after installation.

2. Description of the Prior Art

A track lighting system typically comprises an elongated channel that is typically in either a square or rectangular configuration having a back, two sides and a front. The back is mounted to a support such as a ceiling or wall, with the front side facing downwardly or outwardly therefrom and presenting an open elongated slot therein for receiving the adapter ends of light fixtures Electrical conductor strips are mounted within the track and arranged to be contacted by terminals disposed on the adapters for applying electrical power to the light fixtures.

A track circuit is initially installed with a certain number of light fixtures arranged through the open slot in a certain manner to provide a desired pattern of lighting. However, being that the electrical conductor strips are designed for easy removal and repositioning of the light fixtures, and the track sized to accept additional light fixtures, it is usual that the initial, and any succeeding arrangement and number of light fixtures, is often changed. Since a track circuit is capable of safely accommodating only a certain number of light fixtures without electrical circuit overload, the addition of excessive light fixtures results in a fire hazard made more dangerous by the open slot. Further, the open slot leaves "live" electrical components accessible by the user and thus presents a hazard from electrical shock.

Because it increases the cost of the system and since not all users after the initial set up rearrange, replace and/or add additional light fixtures, manufacturers normally do not provide slot covers with their product. The result is the open slot not only tends to worsen certain safety hazards, it results in an unattractive, unfinished appearance. The safety hazards can still be a problem even when a prior art cover covers the spaces between the light fixtures, since such covers are not designed of flame retardant material, or for easy removal and replacement. Further, such slot covers are not designed for easy and quick size variation to accommodate variations in the number and location of light fixtures. Thus, prior art covers are inadequate from a safety standpoint as well as presenting significant installation and replacement difficulties. Consequently, prior art covers are not consistently used, if at all.

A prior art device is shown and described in U.S. Pat. No. 5,664,876, issued to Vafai, et al on Sep. 9, 1997, wherein a Tamper Resistant Cover for Track Lighting is disclosed. This patent is illustrative of prior art covers in that, for instance, the cover structure is removable from the track only with the track is detached from the back support, and hand tools are required for assembly and removal.

Another prior art device is shown and described in U.S. Pat. No. 5,045,981, issued to Nagano on Sep. 3, 1991, wherein a retrofitting cover for the housing of a string-lighting system is disclosed. The cover is held in place by means of a spring-clip mechanism having protuberances and barbs thereon for frictionally anchoring the spring clip and the cover within the housing.

In view of the above and other prior art, what is needed is a new and improved cover for track-lighting systems. Formed as disclosed herein, the cover will provide various advantageous aspects including, but not limited to, easy manual handling without tools during installation and use, lower cost during manufacture, increased safety, and improved appearance after installation.

It is thus an aspect of the present invention to provide a new and improved cover for track-lighting systems that provides electrical hazard protection from the track-lighting power strips, It is another aspect of the invention to provide a new and improved cover for track-lighting systems that is of low cost and is easily manually sized, installed, removed and replaced.

It is a further aspect of the invention to provide a new and improved cover for track-lighting systems that is manufactured with the outward surface colored in accordance with conventional track lighting and is otherwise esthetically pleasing.

It is still another aspect of the invention to provide a new and improved cover for track-lighting that can be painted as desired to conform to the lighting track, or to the installed lighting fixture, thus providing an esthetically pleasing appearance to the installed track lighting system.

Further objects and advantages of the invention will become apparent from the following detailed description of preferred embodiments thereof in connection with the accompanying drawings in which like numerals designate like elements in the various views.

SUMMARY OF THE INVENTION

The invention relates to a track slot cover for track lighting apparatus wherein the system typically comprises a longitudinally extending box-like track that includes a back wall, two side walls, and a front wall having an elongated slot therein. The back wall is adapted to be connected to a support, such as a ceiling or wall. Electrical light fixtures are mounted at selected locations on the front of the track, the interior back wall of the track including electrical conductor strips thereon that are accessible through a slot in the channel to which light fixture terminals are connected.

In accordance with the invention there is provided a flexible slot cover to cover the open slot disposed between light fixtures. The configuration and material of the cover provides for easy manual insertion into and removal from the elongated open elongated slot in the track lighting system without the use of hand tools. The cover is comprised of a flexible, compressible, resilient foam-like material bonded, or otherwise appropriately attached, to a relatively hard but flexible surface. The relatively hard surface has a width greater than the slot such that it is not forced into the slot but rather snugly overlays the edges of the slot in an abutting manner.

The cover can be manufactured in any convenient length since the foam-like material as well as the surface material is of such materials that the cover can be easily cut to any desired length. The compressible portion may be fire retardant and provide electrical insulation, and the surface portion can be manufactured in any desired color, thus providing an esthetically pleasing appearance to the installed track lighting system.

DESCRIPTION OF THE PREFERRED EMBODIMENT

Figure 1:
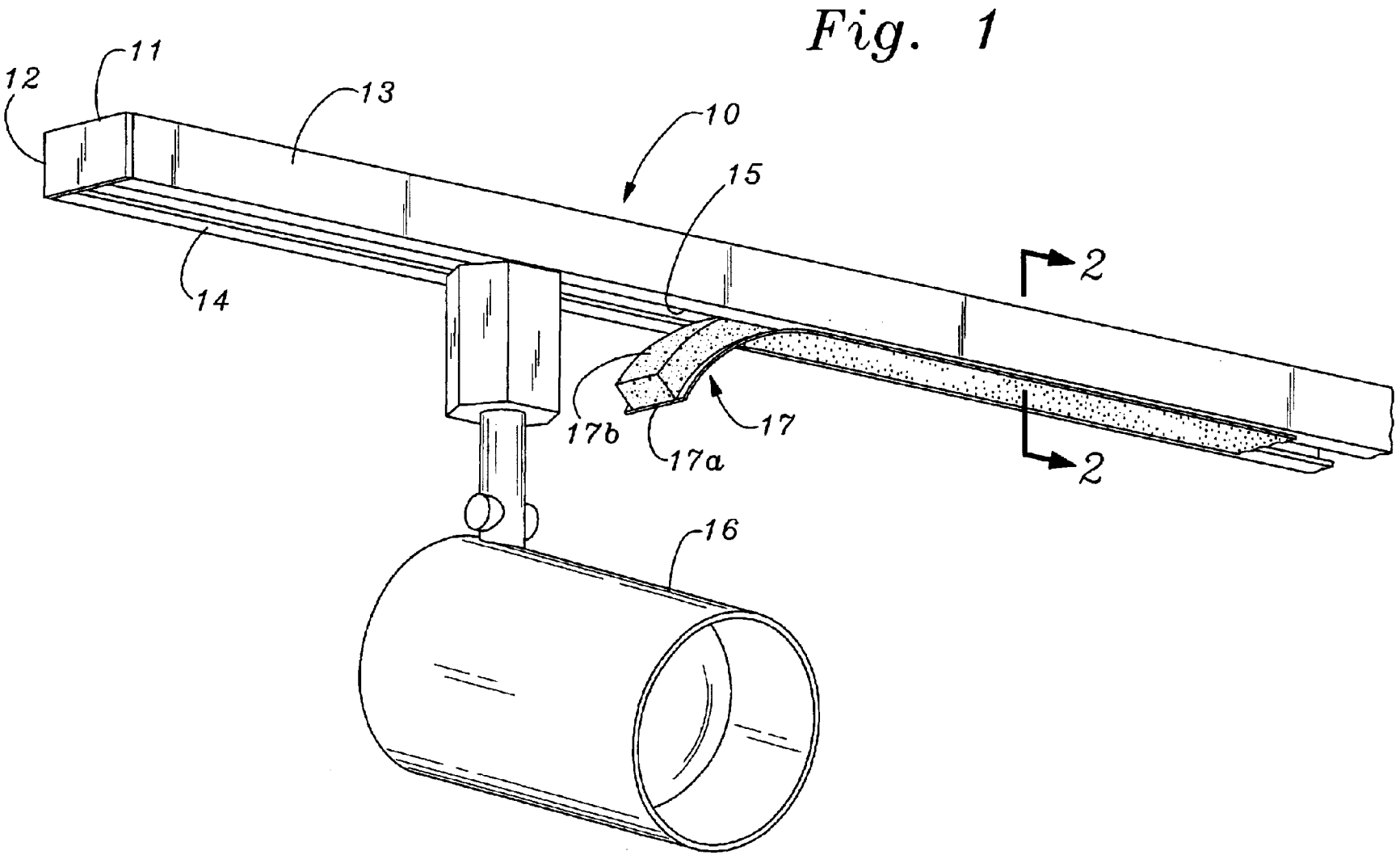
FIG. 1 is a perspective view of a typical track lighting system showing the partially inserted slot cover in accordance with the present invention.

Referring to the drawings in general there is illustrated and disclosed a unique channel slot cover for electrical track lighting systems that provides various advantageous aspects including, but not limited to, increased safety, easy handling during installation, use and replacement, lower cost during manufacture, and improved esthetic appearance after installation. Although other track lighting configurations may be used, the track lighting system shown is typical and comprises a box-like elongated channel that includes a back wall, two side walls, and a front wall having a longitudinally extending slot therein.

The back wall is adapted to be connected to a support, such as a ceiling or wall, with the interior of the back wall including electrical conductors thereon that are accessible through the channel slot to which light fixture electrical terminals are connected. Although the present invention applies to any track lighting configuration having an open access slot for receiving light fixtures, this typical type of track lighting is used to depict and disclose the invention.

Turning now to the figures, FIG. 1 depicts a typical track lighting system, generally designated 10. The system shown comprises a box-like longitudinal channel configuration that includes a back wall 11, two side walls, 12 and 13 respectively, and a front wall 14 having an elongated slot 15 therein. Although not shown, the back wall is adapted to be connected to a support, such as a ceiling or wall, the interior back wall of the track including electrical conductors thereon that are accessible through the front wall slot 15 to which light fixture electrical terminals are connected. An electrical light fixture 16 is shown typically mounted on the front wall 14 of the track through slot 15.

Figure 2:
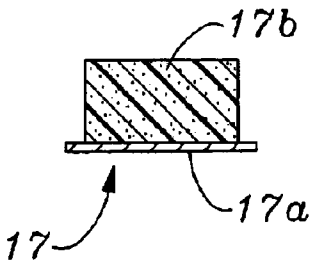
FIG. 2 is a cross-sectional view taken along the line 2—2 of the track lighting system shown in FIG. 1.
Figure 3:
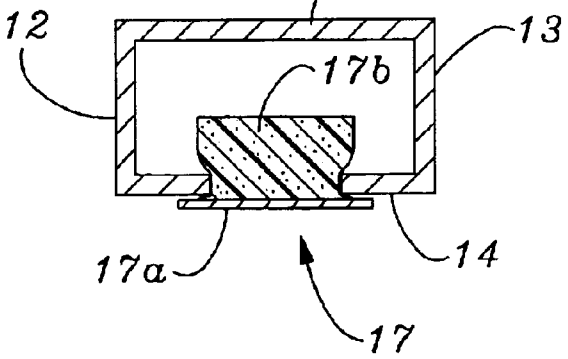
FIG. 3 is a cross-sectional view of the slot cover in accordance with the track lighting system shown in FIG. 1.

In accordance with the present invention, channel slot cover, generally designated 17, is shown in cross section in FIG. 2 comprised of a surface portion 17*a* and an insertion portion 17*b* Insertion portion 17*b* is comprised of flexible, compressible, resilient foam-like material and if desired electrical insulating and fire retardant features are provided. Insertion portion 17*b* is bonded, or otherwise attached, to surface portion 17*a*, which is comprised of a relatively hard but flexible material. Slot cover 17 is shown in FIG. 1 with a portion thereof inserted into slot 15. In FIG. 3 it is shown fully inserted into slot 15 whereby the resiliency of the material provides for a close snug fit plugging the slot 15.

The flexible and compressible insertion portion 17*b* is dimensioned and configured for easy manual insertion a desired depth through slot 15 until abutted against the bottom of surface portion 17*a*, thereby plugging of said slot 15. Surface portion 17*a* is dimensioned and configured of relatively hard material such that as shown in FIG. 3 is not forced into the slot. The relatively hard surface of portion 17*a* has a width greater than the opening of slot 15 such that it is not forced into the slot but snugly overlays the edges of the slot in an abutting manner.

Slot cover 17 can be manufactured in any convenient length since the foam-like material of insertion portion 17*b* as well as the material of surface portion 17*a* is such that the cover 17 can be easily cut to any desired length. Further, the surface portion 17*a* of the cover 17 can be manufactured in any desired color, thus providing an esthetically pleasing appearance to the installed track lighting system. It is composed of a flexible material to facilitate easy installation and removal of the cover.

An example of an available and suitable material for insertion portion 17*b* is polyester foam (UL 94), approved for heat and fire. An example of an available and suitable material for surface portion 17*a* is a flexible melamine edge-banding heat resistant, or the like, material that has a wide range of surface finishing.

Figure 4:
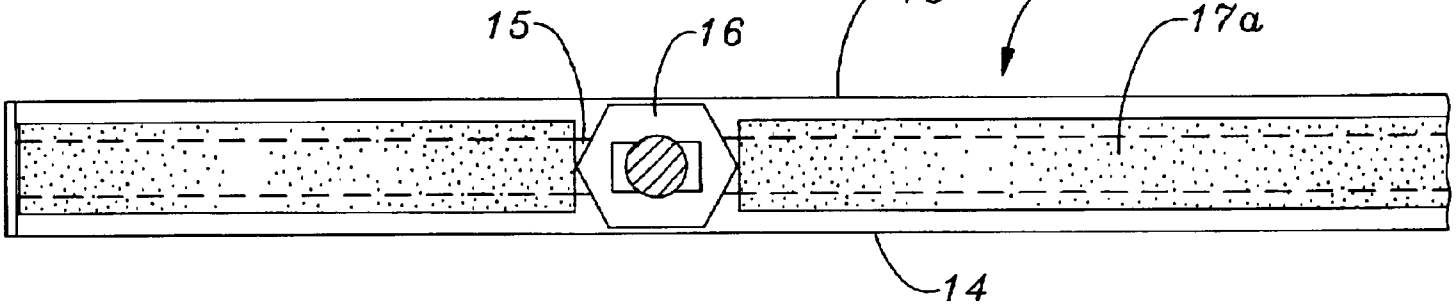
FIG. 4 is a front view of the track lighting system of FIG. 1 showing slot cover strips in accordance with the invention as mounted to cover spaces between light fixtures in the typical track lighting assembly.

FIG. 4 illustrates a front view of the elongated track lighting system of FIG. 1 showing slot cover strips in accordance with the invention mounted to cover spaces between light fixtures in the track lighting assembly. Although not shown, it can be understood that slot cover 17 extends along the slot 15 defining openings in which a plurality of light fixtures are mounted in respective ones of said openings.

Although the present invention has been described in connection with a preferred embodiment thereof, it will be appreciated by those skilled in the art that additions, deletions, substitutions, and other modifications not specifically described herein may be made without departing from the spirit and scope of the invention.

What is claimed is:

1. Electrical track lighting apparatus comprising:

an elongated track for mounting light fixtures thereto, said track including enclosed electrical conductors therein for connection to light fixture terminals for energizing the light fixtures;

a slot extending longitudinally along said track through which said light fixture terminals are connected to said conductors; and a unified slot cover comprised of a compressible lower portion for insertion into said slot and a relatively hard upper portion overlaying the edges of said slot.

2. The track lighting apparatus of claim 1 wherein said unified slot cover is flexible and said upper portion has a width greater than the opening of said slot to preclude insertion of said upper portion into said slot.

3. The track lighting apparatus of claim 2 wherein said cover is manufactured in strips and the materials of said compressible portion and said surface portion provide for easy cutting to desired lengths.

4. The track lighting apparatus of claim 3 wherein said compressible portion is fire retardant foam and said surface portion is a flexible melamine having multiple color finishing.

5. The track lighting apparatus of claim 2 further including a plurality of light fixtures spaced apart to define openings in said slot, and portions of said slot cover are inserted into the slot to cover said openings.

6. The track lighting apparatus of claim 1 wherein said compressible lower portion is resilient and after insertion into said slot expands to provide a plugged fit to said slot.

7. The track lighting apparatus of claim 6 wherein said elongated track includes a back, two side, and a front wall, the back wall adapted to be connected to a support with said conductors mounted on the interior of said back wall, said slot extends longitudinally in said front wall, said apparatus includes a plurality of light fixtures spaced apart to define openings in said slot, and portions of said cover are inserted into said slot to cover said openings.

8. The track lighting apparatus of claim 1 wherein the materials of said said slot cover are fire retardant and electrically insulating and the materials of said compressible lower portion provide for easy removal and reinsertion of said slot cover.

9. Electrical track lighting apparatus comprising:

an elongated track including back, two side, and front walls, the back wall connected to a support, the front wall including an elongated slot for mounting light fixtures thereto, and a plurality of electrical conductors disposed within the track for connection to light fixture terminals for energizing said light fixtures;

a slot cover extending along said slot and having openings in which said light fixtures are mounted; and said cover has a compressible lower portion for easy insertion into said slot and relatively hard upper portion precluding slot insertion whereby said upper portion abuttingly overlays the edges of said slot.

10. The electrical track lighting apparatus of claim 9 wherein said slot cover is flexible and the materials of said compressible lower portion provide for easy removal and reinsertion of said slot cover.

11. The electrical track lighting apparatus of claim 9 wherein said compressible lower portion is resilient such that after insertion through said slot opening said lower portion expands to provide a plugged fit to said slot opening.

12. Electrical track lighting apparatus comprising:

track means for mounting light fixtures thereto, said track including enclosed electrical conductors therein for connection to light fixture terminals;

slot means in said track means having openings for connecting said terminals therethrough to said conductors; and slot cover means for covering exposed portions of said slot means, said slot cover means comprised of a compressible lower portion for insertion into said exposed portions of said slot means and a more rigid upper portion for overlaying the edges of said slot means after insertion of said lower portion.

13. The track lighting apparatus of claim 12 wherein said compressible lower portion is resilient and after insertion through said slot opening expands to provide a plugged fit to said exposed portions of said slot means.

14. The track lighting apparatus of claim 12 wherein said slot cover means is flexible and is manufactured in strips, the materials of said compressible portion and said surface portion providing for easy cutting to desired lengths.

15. The track lighting apparatus of claim 12 wherein the materials of said compressible lower portion provide for easy removal and reinsertion of said slot cover means.

16. The track lighting apparatus of claim 12 wherein the materials of said slot cover means are fire retardant and electrically insulating.

* * * * *